United States Patent [19]

Abdelrazik et al.

[11] Patent Number: 5,025,262

[45] Date of Patent: Jun. 18, 1991

[54] AIRBORNE ANTENNA AND A SYSTEM FOR MECHANICALLY STEERING AN AIRBORNE ANTENNA

[75] Inventors: Mohamed A. Abdelrazik, Rockwall; John D. Martin; Boyd L. Corcoran, both of Greenville, all of Tex.

[73] Assignee: E-Systems, Inc., Dallas, Tex.

[21] Appl. No.: 61,494

[22] Filed: Jun. 15, 1987

Related U.S. Application Data

[63] Continuation-in-part of Ser. No. 927,387, Nov. 6, 1986, abandoned.

[51] Int. Cl.[5] ..... H01Q 3/08

[52] U.S. Cl. ..... 343/705; 343/765; 343/766

[58] Field of Search ..... 343/705, 709, 757, 765, 343/766, 882, 895

[56] References Cited

U.S. PATENT DOCUMENTS

| | | | |
|---|---|---|---|
| 2,604,698 | 7/1952 | Ewing | 343/765 |
| 2,605,418 | 7/1952 | Grass | 343/765 |
| 2,740,962 | 4/1956 | Hammond, Jr. | 343/7.4 |
| 2,863,148 | 12/1958 | Gammon et al. | 343/895 |
| 3,407,404 | 10/1968 | Cook et al. | 343/765 |
| 3,911,441 | 10/1975 | Stein | 343/709 |
| 4,742,359 | 5/1988 | Ishino et al. | 343/895 |

FOREIGN PATENT DOCUMENTS

| | | | |
|---|---|---|---|
| 890264 | 2/1962 | United Kingdom | 343/765 |

OTHER PUBLICATIONS

Arthur R. Connolly & Jack D. Wills, Jr., "Differential Mount Enhances EHF Antenna Design", Sep. 1985, pp. 87-93.

Kennedy Cycloconic Mounting (Advertisement), Electronics, 7-15-60, vol. 33, #29, p. 19.

*Primary Examiner*—Michael C. Wimer

*Attorney, Agent, or Firm*—Harold E. Meier

[57] ABSTRACT

A helical-element antenna as part of a communication system is mechanically steered with reference to an azimuth axis and an elevation axis within a positioning envelope greater than hemispherical. The system for mechanically steering the helical antenna includes a supporting frame having an azimuth member with a longitudinal axis coinciding with the azimuth axis around which the antenna rotates. Further, the supporting frame includes an elevation member that is integral with the azimuth member and has a longitudinal axis displaced from the azimuth axis. An interface fitting rotatably mounts the antenna to the elevation member. The supporting frame is rotatably mounted to a pedestal base that has a plane perpendicular to the azimuth axis. To position the antenna about the azimuth axis, an azimuth steering unit is energized to rotate the supporting frame 360 degrees around the azimuth axis. For positioning the antenna about the elevation axis, an elevation steering unit rotates the interface fitting and the antenna through a gear coupling about the elevation axis. The total rotation excursion about the elevation axis is typically 180 degrees and points the antenna through a range of elevation angles.

17 Claims, 3 Drawing Sheets

AIRBORNE ANTENNA AND A SYSTEM FOR MECHANICALLY STEERING AN AIRBORNE ANTENNA

TECHNICAL FIELD

This continuation-in-part of application Ser. No. 927,387, filed Nov. 6, 1986, now abandoned.

This invention relates to a system for mechanically steering, with reference to an azimuth axis and an elevation axis, an airborne high gain antenna; and more particularly to a system for mechanically steering an airborne antenna with reference to non-orthogonal azimuth and elevational axes.

BACKGROUND ART

Heretofore, a number of systems have been developed to non-mechanically steer an airborne antenna of a communication system. These previous systems have been less than satisfactory because of degradation of antenna performance parameters such as: gain, axial ratio, beam width, and sidelobe levels, to illustrate a few examples. Such parameters were noted to be degraded as a function of the steering angle of such non-mechanically steered systems. Further, early non-mechanical steered systems had limited coverage of the total field of view from a given position.

In accordance with the present invention there is provided a system for mechanically steering an airborne antenna that provides for more than hemispherical coverage as the antenna is differentially positioned about non-orthogonal azimuth and elevational axes. Mechanically steering the antenna provides the advantage of minimizing or eliminating the degradation of the important antenna figures of merit.

The antenna system of the present invention meets the technical requirements of satellite networks with which the antenna may interface. For example, the antenna steered by the system of the present invention finds utility in communication with a satellite system for air traffic control, passenger telephone and telex services, airline communications, and navigational communications, all over either secure or clear transmission links.

Typically the antenna of the present invention which may be positioned by the system of the present invention comprises a radiating helical element that is designed to maximize antenna gain and minimize axial ratio. In one embodiment of the invention, the element itself is surrounded by a metal cone in an effort to decrease the beam width of the helical element with the resulting advantage of increasing the gain of the antenna. Such a metal cone, however, is not a requirement for operation of the helical antenna of the present invention. In a conventional communication system, the helical antenna element interfaces to a diplexer, a low noise amplifier, and a high power amplifier.

Although not limited thereto, the steering system of the present invention finds application for mounting an antenna on the vertical stabilizer of a Boeing 747 type aircraft. Also, the steering system finds utility for mounting an antenna on the fuselage of many presently operating aircraft. In all applications, a radome protects the antenna and the positioning system from the airborne environment, and provides an installation with a desired aerodynamic shape to minimize drag.

DISCLOSURE OF THE INVENTION

In accordance with the present invention, there is provided an antenna/pedestal assembly for an airborne communication system including an antenna positionable with reference to an azimuth axis and an elevation axis. The antenna includes a radiating helical element with or without a metal cone mounted to surround the helical element in an effort to decrease the band width and increasing the gain of the radiating element. The assembly of the radiating element, with or without the metal cone, is mounted to a pedestal to be positionable thereby about the azimuth axis and the elevation axis. The pedestal includes an azimuth member having a longitudinal axis coinciding with the azimuth axis of the system, said azimuth member rotatable about the azimuth axis, and an elevation member integral with the azimuth member and having a longitudinal axis non-orthogonally positioned with reference to the azimuth axis, the elevation member mounted for rotation about the elevation axis.

Further in accordance with the present invention, there is provided a system for mechanically steering, with reference to an azimuth axis and an elevation axis, an airborne high gain antenna. To support and articulate the antenna, the system comprises a support frame, a pedestal base ring, an azimuth steering unit and an elevational steering unit. Specifically, the support frame comprises a differential mount which includes an azimuth member having a longitudinal axis coinciding with the azimuth axis of the system and an elevation member integral with the azimuth member and having a longitudinal axis differentially displaced from the azimuth axis and coinciding with the elevation axis of the system. Further, the system includes means for rotatably mounting the support frame to the pedestal base ring. Also included within the system is a means for rotatably mounting the high gain antenna with reference to the elevation member of the support frame.

BRIEF DESCRIPTION OF THE DRAWINGS

For a more complete understanding of the present invention and the advantages thereof, reference is now made to the following description taken in conjunction with the accompanying drawing in which:

FIG. 6 is a block diagram of a single element helical antenna system for use with the pedestal assembly of the present invention.

DETAILED DESCRIPTION

Figure 1:
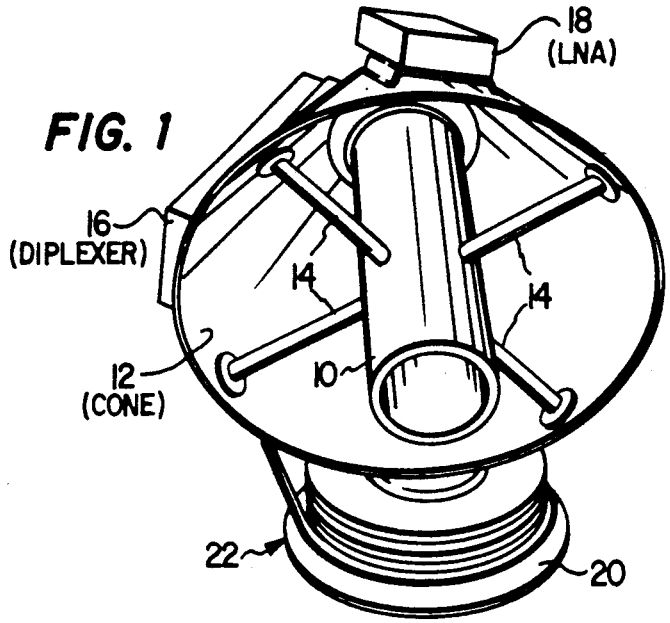
FIG. 1 is a pictorial view of a system for mechanically steering an airborne antenna in accordance with the present invention.
Figure 5:
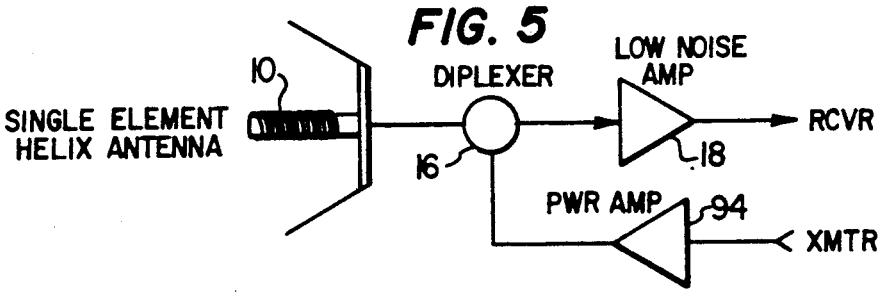
FIG. 5 is a block diagram of an aeronautical high gain antenna system including the antenna/pedestal assembly of FIG. 2.

Referring to FIG. 1, there is shown a pictorial view of a steerable/antenna and pedestal assembly in accordance with the Present invention including a single helix antenna element 10 surrounded by a metal cone 12 that functions to decrease the beamwidth of the helical element and therefore increase the gain of the antenna. The helical element 10 is supported in the metal cone 12 by crossbracing supporting rods 14 where each of the supporting rods is made from a composite non-metallic material. The cone 12 may also be made of a non-metallic material and serve only as a mechanical support for the antenna element 10. Supported on the cone 12 are electronic components of the antenna system including a diplexer 16, a low noise amplifier 18 and a power amplifier (not shown). The high power amplifier is located either on the cone 12 or in the interior of an aircraft when the system is mounted to an aircraft. These electronic components are interconnected into an antenna system such as illustrated in FIG. 5, to be described.

The antenna element is mechanically steered by a differentially mounted pedestal including a pedestal base ring 20 to which is rotatably mounted a support frame 22.

Figure 2:
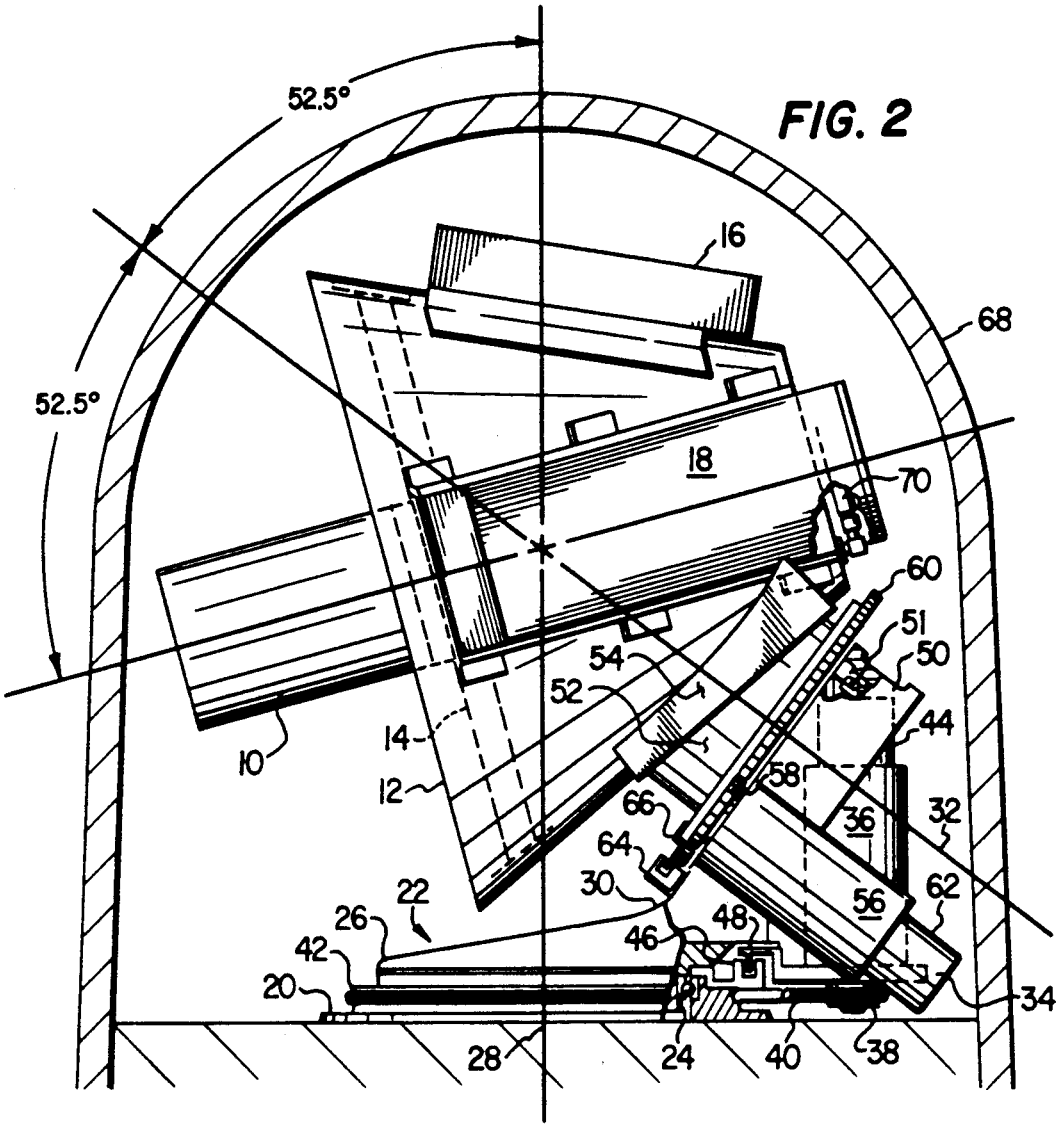
FIG. 2 is a side view, partially cut away of the system of FIG. 1 showing the antenna/pedestal assembly for the antenna of FIG. 1.

Referring to FIG. 2, there is shown the differentially mounted pedestal including the pedestal base ring 20 to which is rotatably mounted by means of a bearing 24 the support frame 22. The support frame 22 includes an azimuth member 26 having a longitudinal axis coinciding with the azimuth axis 28 of the antenna system. Integrally formed with azimuth member 26 is an elevation member 30 having a longitudinal axis coinciding with the elevation axis 32 of the antenna system. As illustrated in FIG. 2, as an example, the angular displacement between the azimuth axis 28 and the elevational axis 32 is 52.5 degrees providing an elevation pointing range of 105 degrees, from −15 degrees to +90 degrees. The angle of displacement between the azimuth axis and the elevation axis is selected to provide the desired elevation pointing as the antenna 10 is rotated about the azimuth axis 28 and the elevation axis 32.

In one embodiment of the present invention, the antenna element 10 rotates about the elevational axis 32 from a position of −15 degrees to a position of +90 degrees relative to the plane of the base ring 20.

Attached to the azimuth member 26, is a motor support 34 to which is mounted an azimuth steering unit 36 comprising a position encoder 44 and a drive motor having a drive and sprocket 38. An azimuth drive cogged belt 40 engages the drive sprocket 38 and also engages a fixed sprocket 42 of the pedestal base ring 20. Energization of the azimuth steering drive unit causes the entire support frame 22 including the azimuth member 26 to be rotated with reference to the pedestal base ring 20 around the azimuth axis 28. The support frame 22 is free to rotate 360 degrees with reference to the base ring 20.

To limit and reference to a key position of the azimuth member 26 with reference to the pedestal base ring 20, an azimuth limit switch including a Hall-effect sensor 46 and a vane 48 is fixed to the pedestal ring 20 and the azimuth member 26. The position of the azimuth axis is determined by monitoring the output on an azimuth encoder 44 by counting and storing pulse data relative to the azimuth reference key identified by the limit switch. Subsequent to the arrival at the reference key position, azimuth feedback signals from the azimuth encoder 44 are applied to an antenna control unit to digitally control energization and rotational displacement of the azimuth steering unit 36.

Integral with the elevation member 30 is an elevation bearing housing 50 that includes bearing members (one shown 51) for rotatably supporting an antenna/pedestal interface fitting 52. The antenna/pedestal interface fitting 52 includes a hollow bearing internal to the bearing member and a U-shaped bracket 54 attached to the outer surface of the metal cone 12.

Supported by the elevation bearing housing 50 is an elevation steering unit 56 for rotatably driving a pinion gear 58 that engages a driven gear 60. The driven gear 60 is secured to the antenna/pedestal interface fitting 52 such that energization of the elevation steering unit 56 causes rotation of the cone 12 and the supported antenna element 10 around the elevation axis 32. To limit and reference to a key position of the antenna element 10 with reference to the elevation axis 32, there is provided an elevation limit switch assembly including a Hall-effect position sensor 64 mounted to the elevation member 30 and a sensor actuating vane 66 mounted to the antenna/pedestal interface fitting 50. Elevation feedback signals from an elevation encoder 62 are applied to the antenna control unit for monitoring the actual position of the elevation axis referenced to the elevation limit switch assembly.

Typically, the antenna and pedestal assembly of the present invention is designed for installation on the vertical stabilizer of a Boeing 747 type aircraft, or on the fuselage of other aircraft. In any installation, the antenna and pedestal assembly is enclosed within a radome 68 to protect the assembly from the airborne environment and provide the desired aerodynamic configuration to minimize drag forces.

Additional components of the system illustrated in FIG. 2 include the diplexer 16 and the low noise amplifier 18 attached to the outer surface of the cone 12. These various electronic components are interconnected to the helical antenna 10 by means of an element connector 70. Such a connector and interconnections between the antenna element 10 and the various electronic components are part of a conventional installation and interconnection system.

Figure 3:
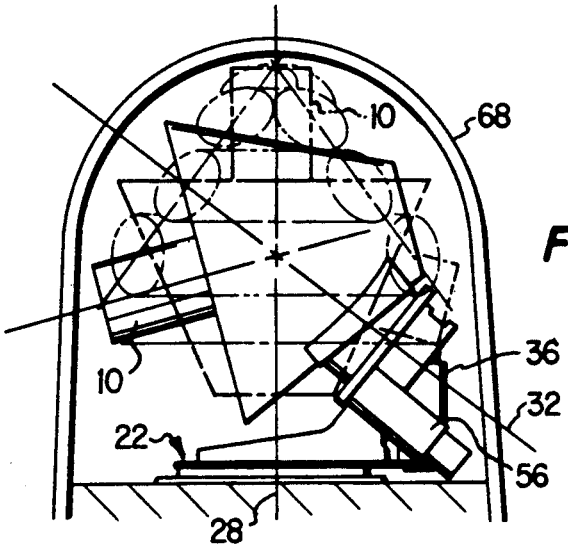
FIG. 3 is a schematic illustration of the movement of the antenna around the azimuth and elevational axes.
Figure 4:
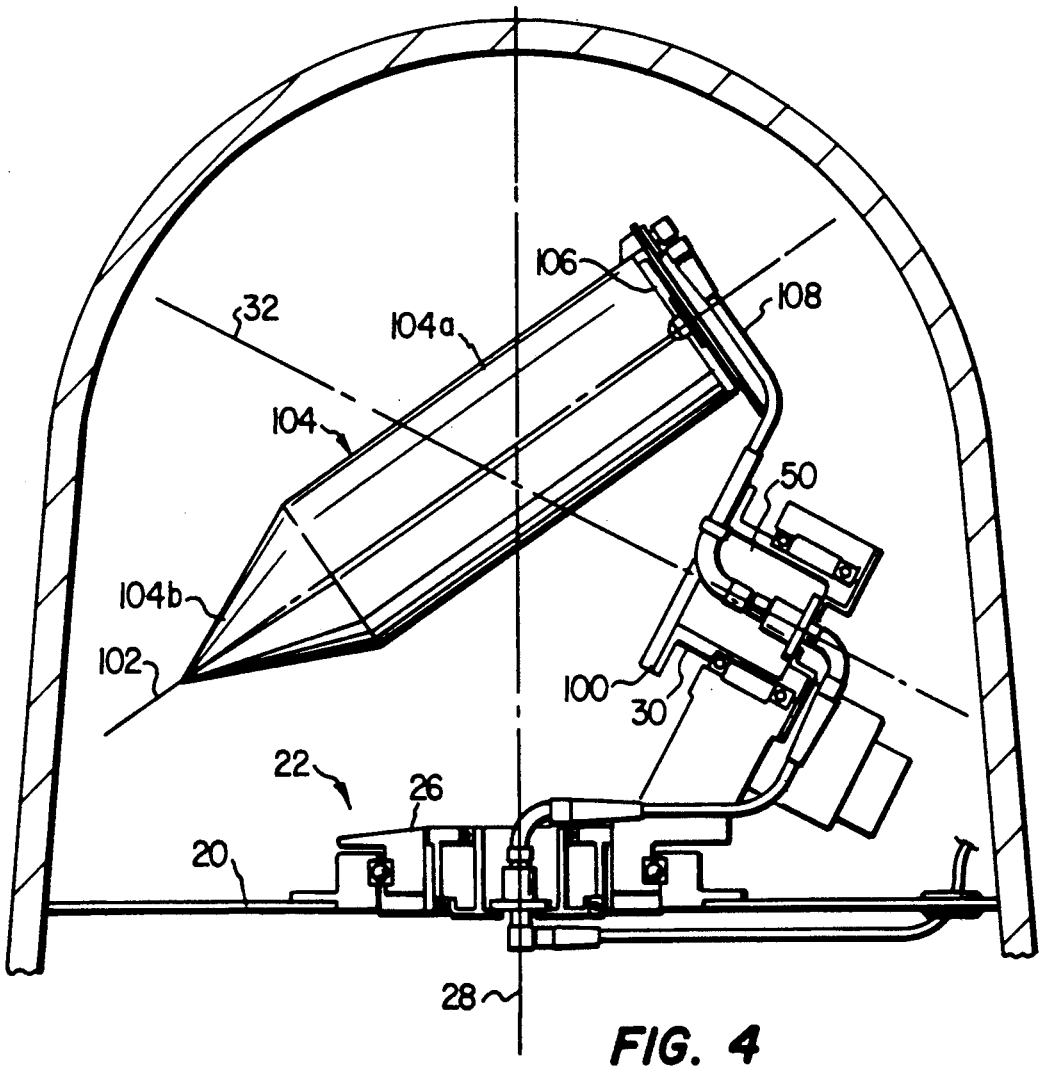

Referring to FIG. 3, there is schematically illustrated the antenna/pedestal assembly of FIG. 2 for positioning the antenna 10 with reference to the azimuth axis 28 and the elevation axis 32. Shown in dotted outline are various positions of the antenna 10 as it rotates about the elevation axis 32. As illustrated, the antenna 10 may be positioned in elevation from approximately −15 degrees to +90 degrees with reference to the plane of the base ring 20. In any of the positions illustrated, the antenna is also positionable about the azimuth axis 28 by rotation of the support frame 22 with reference to the base ring 20. As previously discussed, the antenna 10 is rotatable through 360 degrees around the azimuth axis 28. This combined rotational envelope provides pointing coverage which exceeds a hemispherical configuration and is achievable by the mechanical pedestal element of the present invention. The desired position for the antenna 10 is determined by the antenna control unit to be described with reference to FIG. 5.

Figure 4:
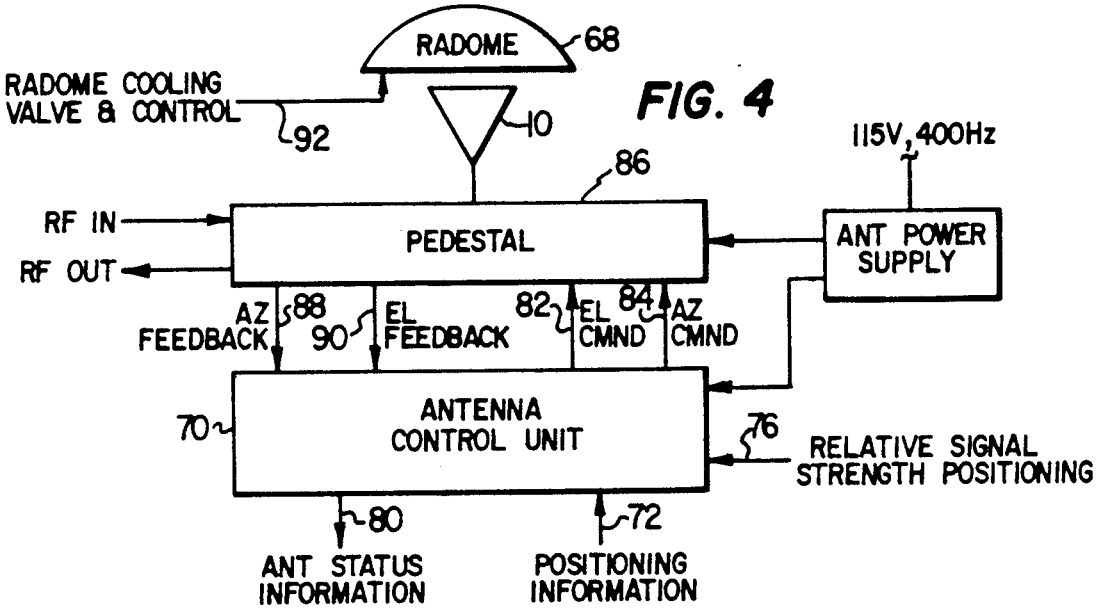
FIG. 4 is a side view, partially cut away, of an alternate embodiment of the helical antenna element of the present invention and the mounting thereof with reference to the antenna/pedestal assembly.

Referring to FIG. 4, there is shown an alternate embodiment of the helical antenna element supported on the differentially mounted pedestal of the present invention wherein like reference numerals are used for parts found in FIGS. 1 through 3. The differentially mounted pedestal includes the pedestal base ring 20 of FIG. 2 to which is mounted the support frame 22. The support frame 22 includes an azimuth member 26 having longitudinal axis coinciding with the azimuth axis 28 of the antenna system. Integrally formed with the azimuth member 26 is an elevation member 30 having a longitudinal axis coinciding with the elevation axis 32 of the antenna system. The differentially mounted pedestal of FIG. 4 provides substantially the same angular displacement between the azimuth axis 28 and the elevation axis 32 as the differential mounted pedestal of FIG. 2.

Also similar to the differentially mounted pedestal of FIG. 2 is an azimuth steering unit comprising a position encoder and a drive motor, not detailed in FIG. 4. As explained with reference to FIG. 2, energization of the azimuth steering drive unit causes the entire support frame 22 including the azimuth member 26 to be rotated with reference to the pedestal base ring 20 around the azimuth axis 28.

Integral with the elevation member 30 is an elevation bearing housing 50 that includes bearing members for rotatably supporting an antenna/pedestal interface fitting 100. As illustrated, the fitting 100 is a support bracket having two sections integrally formed at an oblique angle to support the antenna about an axis 102. Attached to the antenna/pedestal interface fitting 100, is a single helix antenna element 104. This helix antenna element 104 is attached to and supported by the fitting 100 by means of a bracket 106. RF energy from the antenna element to the electronic components of the antenna system is by means of energy guides 108.

As illustrated in FIG. 4, the antenna element 104 comprises two sections, a first section **104*a* having a substantially uniform diameter terminating in a cone shaped section 104*b* tapering from a base integral with the section 104*a* to an apex. The antenna element 10 of FIG. 2 and antenna element 104 of FIG. 4** provide somewhat varying characteristics that depends on the use of the antenna system of the present invention.

As illustrated in FIG. 4, the antenna element 104 is mounted to the differentially mounted pedestal directly by means of the fitting 100. This is an alternate construction of the antenna system of the present invention in that the cone 12 is not utilized in the embodiment of FIG. 4.

Also included in the mechanism of FIG. 4 is an elevation steering unit that when energized causes rotation of the antenna element 104 about the elevation axis. This is a similar construction to the pedestal of FIG. 2.

Additional components of the system illustrated in FIG. 2 including the diplexer 16 and the low noise amplifier 18 are positioned remote from the pedestal of FIG. 4 inasmuch as this embodiment does not utilize the cone 12 for mounting purposes. As described previously, these various electronic components are interconnected to the helical antenna 104 by means of various guides and connectors.

Referring to FIG. 5, there is shown a block diagram of the antenna/pedestal assembly for an antenna system of FIGS. 1, 2 and 4 including an antenna control unit 70. This control unit receives positioning information for position control of the antenna 10 or the antenna 104 on an input line 72. Also coupled to the antenna control unit are relative receive signal strength inputs on input line(s) 76. These relative strength signals are received from the helical antenna electronic components to position the antenna 10 or the antenna 104 to maximize received signal strength.

In addition to position control signals for the pedestal steering units 36 and 56, the antenna control unit 70 outputs antenna status information on a line 80.

Functionally, the antenna control unit 70 operates to provide elevation command signals on line(s) 82 to the elevation steering unit 56 and azimuth command signals on line(s) 84 to the azimuth steering unit 36. In FIG. 5 these command signals are shown applied to the pedestal represented by a functional block identified by the reference numeral 86. Also applied to the pedestal 86 are RF input signals to the antenna 10 or the antenna 104 and RF output signals received by the antenna.

As previously explained, the position of the azimuth member 26 and the elevation member 30 is monitored by means of encoders 44 and 62, respectively (FIGS. 2 and 4). Feedback signals from these encoders are applied by means of lines 88 and 90 to the antenna control unit 70.

Also illustrated in FIG. 5 is the radome 68 provided with controlled cooling by means of a conduit 92. Cooling of the radome 68 is conventional and further description is not deemed necessary for an understanding of the present invention.

In operation, the antenna control unit 70 receives the various input signals which are evaluated and processed for differential coordinate conversion to determine the required rotation at the azimuth axis 28 and the elevational axis 32 to achieve the desired pointing angles of the antenna 10 or the antenna 104. Azimuth command signals are generated and applied to the azimuth steering unit 36 and elevation command signals are applied to the elevational steering unit 56. The respective steering units are engerized until the desired position for the antenna is identified by means of the feedback signals from the encoders 44 and 62. Thus, the antenna control unit 70 along with the steering units 36 and 56 are part of a servo control system including a feedback loop provided by the encoders 44 and 62.

Referring to FIG. 6, there is shown a block diagram of the antenna system where the single element helical antenna 10 is interconnected to electronic components of the system. Radiating helical elements of the antenna 10 are connected to the diplexer 16, which in the receive mode, applies an RF input to a low noise amplifier 18. In a transmit mode, the diplexer 16 receives RF output signals from the power amplifier 94. In accordance with conventional antenna systems, the low noise amplifier 18 is connected to a receiver and the power amplifier 94 is connected to a transmitter. A further description of such a receiver and transmitter is not considered necessary to understand the present invention and will not be further described.

Although the invention has been described in detail, the same is by way of illustration and example only and is not to be taken by way of limitation, the spirit and scope of the invention being limited only to the terms of the appended claims.

We claim:

1. An antenna/pedestal assembly for an airborne communication system, comprising:

an antenna having a longitudinal axis and including a radiating element positionable with reference to an azimuth axis and an elevation axis;

a pedestal including a pedestal base, an azimuth member having a longitudinal axis coinciding with the azimuth axis of the system, means to couple the azimuth member to the pedestal base to permit rotation of said azimuth member, azimuth steering unit to rotate the azimuth member with reference to the pedestal base, elevation member integral with the azimuth member and having longitudinal axis non-orthogonal to and intersecting the azimuth axis, interface means to couple said antenna to the elevation member of said pedestal with the longitudinal axis of the antenna non-orthogonal to and intersecting the longitudinal axis of the elevation member to permit rotation of said antenna with reference to the elevation member such that in at least one position of the antenna the longitudinal axis thereof coincides with the azimuth axis, elevation steering unit to rotate the interface means and the antenna with reference to the elevation member; and antenna control unit, coupled to the azimuth steering unit and the elevation steering unit, to generate steering control signals in response to antenna position signals, RF signals received by said antenna and navigational and altitude information signals.

2. An antenna/pedestal assembly for an airborne communication system as set forth in claim 1 wherein said radiating element includes a first section of subsantially uniform diameter integral with a second cone-shaped section.

3. An antenna/pedestal assembly for an airborne communication system as set forth in claim 1 further including a protective cover enclosing said antenna and said pedestal.

4. An antenna/pedestal assembly for an airborne communication system as set forth in claim 1 wherein the angle of the longitudinal axis of the elevation member with respect to the longitudinal axis of the azimuth member is selected to afford positioning of said antenna to cover an area greater than hemispherical.

5. A system mounted on an aircraft for mechanically steering an airborne directional antenna comprising pedestal means for mounting on the aircraft an antenna means having a radiating element, said pedestal means comprising a first member coupled to the surface of said aircraft for rotation about a first axis and a second member, said antenna means coupled to said second member for rotation about a second axis non-orthogonal to and intersecting said first axis, said second member connected to said first member and displaced from said first axis at an angle such that said first axis does not substantially intersect said second member, said first axis and said second axis intersecting at an angle at a location in a direction removed from the surfaces of said first and second members to permit rotation of said antenna means, and said antenna supported such that radiation therefrom propagates along a primary axis that non-orthogonally intersects said second axis to form a predetermined angle with said second axis and coincides in at least one position of the antenna with the first axis.

6. An antenna/pedestal assembly for an airborne communication system as set forth in claim 5 further including a protective cover enclosing said antenna and said pedestal.

7. A system mounted on an aircraft for mechanically steering an airborne directional antenna as set forth in claim 5 further comprising pedestal steering means to steer said pedestal means about said first axis and antenna steering means to steer said antenna means about said second axis.

8. The system mounted on an aircraft for mechanically steering an airborne directional antenna according to claim 7 further comprising an antenna control unit coupled to said pedestal steering means and said antenna steering means to receive signals corresponding to the antenna position, RF signals received by said antenna, and navigational and altitude information signals.

9. The antenna/pedestal assembly for an airborne communication system as set forth in claim 5 wherein said antenna means is mounted to permit greater than hemispherical coverage by said primary axis.

10. A system according to claim 5 wherein said predetermined angle and the angle formed by the intersection of said first and second axes are chosen to permit said primary axis to point in a direction within a hemisphere above said pedestal means bounded by a plane orthogonal to said first axis and intersecting said first axis at said location, and also to permit said primary axis to point in an azimuth direction and in elevation below the plane down to a maximum predetermined elevation.

11. A system according to claim 10 wherein said predetermined angle and the angle formed by the intersection of said first and second axes are chosen to permit pointing of said primary axis in all directions of azimuth and in all directions of elevation between $-15°$ to $+90°$ with respect to said plane orthogonal to said first axis.

12. A system on an aircraft for mechanically steering an airborne directional antenna comprising:

antenna means comprising a radiating helical element having a pointing axis;

a supporting frame coupled to the surface of the aircraft;

azimuth steering means coupled to said frame and including means rotatable in azimuth about a first axis with respect to said frame;

elevation steering means mounted on said azimuth steering means, and including means rotatable about a second axis non-orthogonal to and intersecting said first axis;

means for mounting the antenna means on said elevation steering means with the antenna radiating element pointing axis non-orthogonal to and intersecting the second axis such that rotation of said antenna means about both said first and second axes enables the antenna radiating element pointing axis to be positioned in any direction in azimuth and any direction in elevation and in at least one position of the antenna means the antenna radiating element pointing axis coincides with the first axis; and antenna control unit responsive to signals corresponding to antenna position signals, RF signals received by the antenna, and navigational and altitude information signals to generate steering control signals applied to said azimuth steering unit and said elevation steering unit.

13. An antenna/pedestal assembly for an airborne communication system, comprising:

an antenna having a longitudinal axis and including a radiating element positionable with reference to an azimuth axis and an elevation axis; and a pedestal including a pedestal base, an azimuth member having a longitudinal axis coinciding with the azimuth axis of the system, means to couple the azimuth member to the pedestal base to permit rotation of said azimuth member, azimuth steering unit to rotate the azimuth member with reference to the pedestal base, elevation member integral with the azimuth member and having a longitudinal axis non-orthogonal to and intersecting the azimuth axis, interface means to couple said antenna to the elevation member of said pedestal with the longitudinal axis of each non-orthogonal to the other to permit rotation of said antenna with reference to the elevation member such that in at least one position the antenna longitudinal axis coincides with the azimuth axis, elevation steering unit to rotate the interface means and the antenna with reference to the elevation member.

14. An antenna/pedestal assembly for an airborne communication system as set forth in claim 13 wherein said antenna further includes a cone, and means for mounting said radiating element into said cone.

15. An antenna/pedestal assembly for, an airborne communication system as set forth in claim 14 wherein said antenna further includes means for mounting electronic components of a communication system to the exterior surface of said cone.

16. An antenna/pedestal assembly for, an airborne communication system as set forth in claim 13 further including a protective cover enclosing said antenna and said pedestal.

17. An antenna/pedestal assembly for an airborne communication system as set forth in claim 13 wherein the angle of the longitudinal axis of the elevation member with respect to the longitudinal axis of the azimuth member is selected to afford positioning of said antenna to cover an area greater than hemispherical.

* * * * *

UNITED STATES PATENT AND TRADEMARK OFFICE

CERTIFICATE OF CORRECTION

PATENT NO. : 5,025,262

DATED : June 18, 1991

INVENTOR(S) : Mohamed A. Abdelrazik, et al.

It is certified that error appears in the above-identified patent and that said Letters Patent is hereby corrected as shown below:

Column 2, line 68, change "Present" to --present--;

Column 6, line 17, change "92," to --92.--;

Column 6, line 68, insert --a-- after "having";

Column 8, line 17, change "the angle" to --said angle--;

Column 9, line 11, delete the comma after "for".

Signed and Sealed this

Second Day of February, 1993

*Attest:*

STEPHEN G. KUNIN

*Attesting Officer*

*Acting Commissioner of Patents and Trademarks*